United States Patent [19]

Kaucic

[11] 4,425,955

[45] Jan. 17, 1984

[54] VERTICAL BLIND MECHANISM

[75] Inventor: Edward M. Kaucic, Middleton, Wis.

[73] Assignee: Graber Industries, Inc., Middleton, Wis.

[21] Appl. No.: 378,759

[22] Filed: May 17, 1982

[51] Int. Cl.[3] ..... E06B 9/30

[52] U.S. Cl. ..... 160/168 R

[58] Field of Search ..... 160/166-178, 160/345

[56] References Cited

U.S. PATENT DOCUMENTS

| | | | |
|---|---|---|---|
| 2,755,854 | 7/1956 | McIntire . | |
| 3,199,142 | 8/1965 | Salzmann et al. | 160/345 |
| 3,996,988 | 12/1976 | de Wit | 160/176 R |
| 4,006,769 | 2/1977 | Woodle . | |
| 4,114,673 | 9/1978 | de Wit et al. | 160/168 R |
| 4,122,884 | 10/1978 | Salzmann | 160/168 R |
| 4,257,470 | 3/1981 | Woodle . | |
| 4,350,197 | 9/1982 | Haller | 160/166 A |

*Primary Examiner*—Peter M. Caun

*Attorney, Agent, or Firm*—Vernon J. Pillote

[57] ABSTRACT

A venetian blind mechanism having a lead and a plurality of auxiliary carriers supported for traversing movement along a header and vane supports mounted on the auxiliary carriers for turning about an upright axis for light control. An operating chain is connected intermediate its ends to the lead carrier and has chain portions extending lengthwise of the header in meshing engagement with sprockets on the auxiliary carriers to control spacing between the auxiliary carriers and to effect rotation of the vane supports. The header has telescoping sections to enable adjustment of the length of the header. The trackway is located at the rear side of the header.

25 Claims, 12 Drawing Figures

VERTICAL BLIND MECHANISM

BACKGROUND OF THE INVENTION

The present invention relates to a vertical blind mechanism in which the vanes are mounted for traversing movement on a header across a window opening between an open and a closed position, and also for angular rotation about an upright axis for light control. Some prior vertical blind mechanisms, for example, as disclosed in U.S. Pat. Nos. 2,755,854; 4,006,769 and 4,257,470, mount the vertical vanes on rotary vane supports for traversing movement along the horizontal header and directly connect the vane supports to a pair of flexible cords or bead chains at fixed locations therealong so that the cords or bead chains control the spacing between adjacent vane supports when the vanes are drawn along the header to a closed position, and the cords or bead chains are also manipulatable to control rotation of the vane supports. In these prior vertical blind mechanisms, the cords or bead chain were connected to the vane supports at locations outside the header and the exposed cords or chains not only adversely affected the appearance of the blind mechanism when it was drawn to a closed position, but also drooped or sagged between the vanes when the blind mechanism was drawn to an open position. Further, direct connecting of the cord or bead chain to the vanes also limited the maximum possible angular rotation of the vanes so that it was difficult to rotate the vanes through a full 180° as is desirable for complete light control by the vanes.

Prior vertical blind mechanisms have utilized a header having a slot along the bottom of the header with the vane supports mounted in the slot for movement along the header. However, when the slot is at the bottom of the header, the slot and some of the blind operating mechanism as well as the undecorated interior of the header is exposed to view from the room side of the blind mechanism. In addition, the operating cords for the traverse mechanism sometime droop into and through the downwardly opening slot in the header.

SUMMARY OF THE INVENTION

It is an object of the present invention to provide a vertical venetian blind mechanism in which the vanes are mounted for traversing movement along a header and for rotary movement about an upright axis for light control, and which has an improved blind operating mechanism for rotating the vanes and controlling the spacing between adjacent vanes.

Another object of this invention is to provide a vertical venetian blind in accordance with the foregoing object in which rotation of all of the vanes can be readily synchronized and which effectively avoids damage to the blind operating mechanism in the event one or more vanes are obstructed during rotation of the vanes.

Another object of this invention is to provide a vertical blind mechanism which can be adjusted in length to accommodate windows of different widths.

A further object of this invention is to provide a vertical blind mechanism in which the operating slot for the vane carriers and the operating mechanism for the blind is effectively concealed from view from the room side of the blind.

Yet another object of this invention is to provide a vertical blind mechanism in which the vanes are mounted on vane carriers for traversing movement along a header and also for rotary movement about an upright axis for light control, and in which the spacing of at least one vane carrier relative to an adjacent vane carrier can be readily adjusted after the vane carriers and operating mechanism are assembled on the header.

Still another object of this invention is to provide a vertical blind assembly in which the vanes are mounted on vane carriers for rotary movement about an upright axis and for traversing movement along a header between a folded condition adjacent one end of the header and an extended position spaced apart along the header, and which has an improved arrangement for releasably latching the vane carriers in extended position on the header.

These, together with other objects and advantages of this invention, will be more readily understood by reference to the following detailed description when considered in connection with the accompanying drawings wherein.

The vertical blind mechanism includes a header rod H adapted to be mounted as by brackets (not shown) on a support surface to extend horizontally across a window opening and rod end caps $C_1$ and $C_2$ at opposite ends of the header rod. A plurality of auxiliary carriers AC are mounted on the rod for traversing movement therealong and a vane support VS is mounted on each auxiliary carrier for turning movement about an upright axis to rotate a vane V supported by each vane support. A lead carrier LC is also mounted on the rod for traversing movement therealong and is extended and retracted by means of a traverse cord TC that extends lengthwise of the rod. A flexible operating chain OC is operatively connected to a lead carrier LC and has first and second chain portions $OC_1$ and $OC_2$ extending lengthwise of the rod and engaging vane drive sprockets on each of the auxiliary carriers to control spacing between the auxiliary carriers when the lead carriage is extended to close the blind, and to control rotation of the vane supports when the first and second chain sections are moved relative to each other. The traverse cord TC and operating chain OC are operated from adjacent one end of the rod and a latch mechanism LM is provided for releasably latching the lead carrier to the other end of the rod to releasably hold the blind in its closed position.

Figure 8:
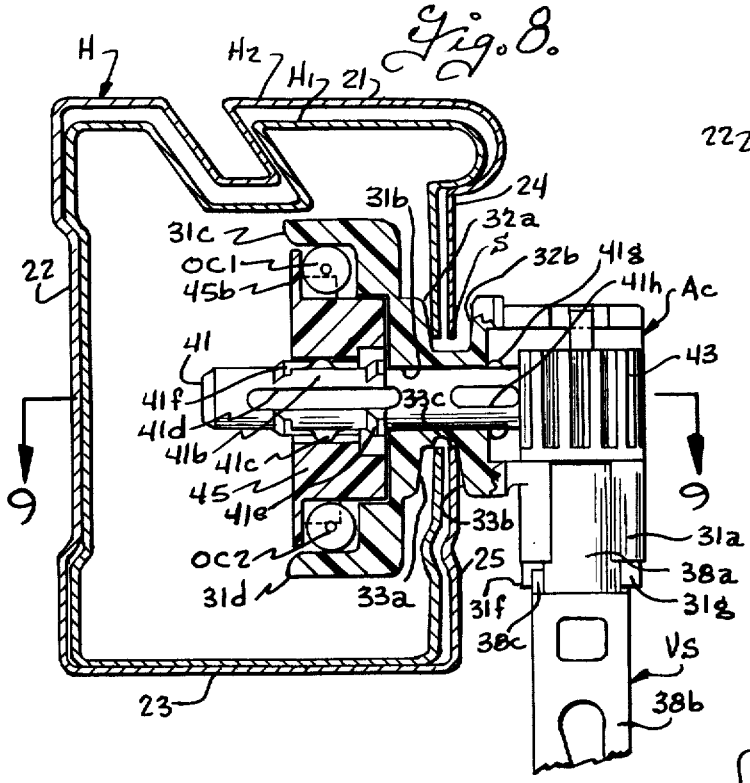
FIG. 8 is a transverse sectional view taken on the plane 8—8 of FIG. 2 and illustrating the parts on a larger scale than FIG. 2.

It is sometimes desirable to be able to adjust the length of the header rod at the time of installation to accommodate windows of different widths and, for this purpose the rod H is advantageously formed in inner and outer telescopically adjustable rod sections $H_1$ and $H_2$. In the preferred embodiment illustrated, the trackway is formed at the rear side of the rod so as to be concealed from view at the front and bottom of the rod. The inner and outer rod sections $H_1$ and $H_2$ have a like configuration except that the inner rod section has a slightly smaller cross-section than the outer rod section to be telescopically receivable therein, and like numerals are used to designate corresponding parts of the inner and outer rod sections. More specifically, the outer and inner rod sections each include a top wall 21, a front wall 22, a bottom wall 23, and upper and lower rear wall portions 24 and 25 that are spaced apart to define a slot S. The auxiliary carriers AC each include a slide body 31 that extends through the slot S in the rod sections. The slide bodies are formed of a resilient wear resisting synthetic resin material and may, for example, be formed of an acetal resin. As best shown in FIG. 8, each slide body has an upper groove with laterally spaced inner and outer upper guide walls **32*a* 32*b* and a lower groove with laterally spaced inner and outer lower guide walls 33*a* and 33*b* arranged to guide the auxiliary carrier along the upper and lower rear rod wall portions 24 and 25. A vane support VS is rotatably supported on each of the slide bodies 31 rearwardly of the header rod for rotation about an upright axis and has a shaft portion 38*a* and a lower vane engaging portion 38*b*. The vane supports VS are of a synthetic resin material which is preferably transparent and may, for example, be formed of a transparent polycarbonate resin. In order to facilitate assembly and also disassembly for replacement of the vane supports, the slide bodies 31 are formed with a semicylindrical sleeve portion 31*a* that extends through slightly greater than 180° and adapted to rotatably receive the generally upright shaft portion 38*a*** of a vane support with a snap fit.

Figure 9:
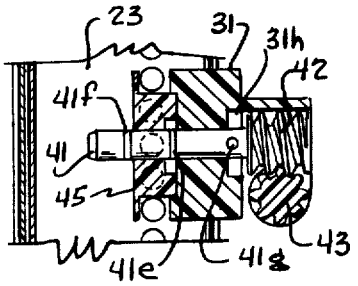
FIG. 9 is a fragmentary horizontal sectional view taken on the plane 9—9 of FIG. 8.
Figure 10:
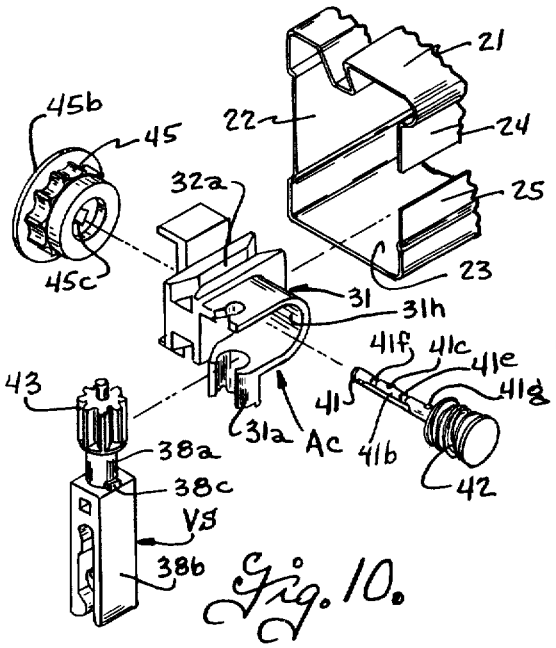
FIG. 10 is an exploded perspective view of one of the vane carriers.

A drive shaft 41 is mounted in a bore **31*b* in each slide body for rotation about a generally horizontal axis transverse to the rear wall of the rod and a right angle gear drive connects the outer end portion of the drive shaft to the vane support. The drive shaft is conveniently formed of a synthetic resin material which may, for example be an acetal resin. As best shown in FIGS. 8 and 9, the right angle drive shaft includes a worm gear 42 formed integrally with the outer end of the drive shaft 41 and which meshes with a worm wheel 43 conveniently formed integrally with the upper end of the shaft 38*a* on the vane support. The gear drive is advantageously arranged to effect a speed reduction between shaft 41 and vane support VS to enable more accurate control of the angular position of the vane support and to also reduce the tension on the operating chain OC required to rotate the vane supports on all of the auxiliary carriers. For example, the worm and worm wheel drive shown provides about an eight to one speed reduction, so that four revolutions of the shaft 41 turn the vane support through 180°. A sprocket 45 is provided on the inner end of the drive shaft on each auxiliary carrier for rotating the drive shaft and chain retainer guides 31*c* and 31*d* are provided on the slide body to guidably retain the first and second runs $OC_1$ and $OC_2$ of the operating chain in meshing engagement with the associated sprocket at diametrically opposite sides of the sprocket. The sprocket has a flange 45*b* at one side and the chain retainer guides 31*c* and 31*d* have a portion extending along the side of the sprocket opposite the flange 45*b* and a portion spaced outwardly from the periphery of the sprocket at diametrically opposite sides thereof for retaining the bead chain in meshing engagement with the sprocket. A slip clutch is advantageously provided in the drive between the sprocket and the vane support to prevent damage to parts in the event one or more of the vanes engages an obstruction during rotation and to also enable synchronization of the vanes on the several auxiliary carriers. The slip clutch is provided between the sprocket 45 and the drive shaft 41 and, as best shown in FIG. 10, the sprocket is provided with a non-circular opening 45*c*, conveniently square in cross-section, and the drive shaft 41 is provided with a radially compressible portion 41*b* that extends into the opening 45*c* in the sprocket and which has a protrusion 41*c* engageable with the noncircular opening 45*c* in the sprocket. The shaft 41 is formed of a resilient plastic material and the radially compressible portion 41*b* is provided by a diametrical slot 41*d* in the shaft. The protuberance 41*c* is provided on the outer periphery of the shaft at a location intermediate the ends of the slot and normally extends into a corner of the non-circular opening 45*c* so that the shaft normally rotates with the sprocket, but can yield in the event rotation of the shaft is restricted. Locating lugs 41*e* and 41*f* are also provided on the outer periphery shaft in the diametrically compressible portion of the shaft and, as best shown in FIG. 8, one end of each of the lugs is beveled or inclined to facilitate insertion of the shaft through the bore 31*b* in the slide and through the opening 45*c* in the sprocket. The lug 41*e* is provided at a location on the shaft to engage the inner side of the slide body 31 to inhibit axial withdrawal of the shaft, and the lug 41*f* is provided at a location to engage the inner side of the sprocket to axially retain the sprocket on the shaft. With this arrangement, the shaft can be pressed through the bore 31*b* in the slide body 31 and through the non-circular opening 45*c* in the sprocket to assemble the drive gear worm and sprocket on the slide body. A lug 38*c* is provided on the shaft portion 38*a* of the vane support VS and arranged to engage stops 31*f* and 31*g* on the sleeve 31*a* to limit angular movement of the vane support. These stops are angularly spaced apart with relation to the lug 38*c*** so that the vane can rotate through slightly greater 180° to assure full closing of the vanes in either of two oppositely rotated positions.

The chain retainer guides **31*c* and 31*d* on each carrier normally maintain the first and second portions of the chains in meshing engagement with the respective sprockets at diametrically opposite sides and maintain a preset spacing of the auxiliary carriers along the chains. There are some occasions, for example when adjusting the length of the rod, that it is desirable to adjust the spacing between one or more auxiliary carriers. For this purpose, provision is made for disengaging the sprocket on one or more of the auxiliary carriers from the bead chains to allow adjustment of the spacing between the auxiliary carriers after the rod is assembled. As best shown in FIGS. 8 and 9, the slide body is formed with a bore 31***h* arranged to permit limited axial movement of the shaft 41 and worm 42 in a direction inwardly of the rod, that is to the left as viewed in FIGS. 8 and 9. A means is provided to releasably retain the shaft in the position shown in FIGS. 8 and 9, in which the sprocket is in meshing engagement with the chain. In the preferred embodiment shown, rounded protuberances 41*g* are provided on the shaft 41 at a location to engage the inner end of the bore 31*h* and normally maintain the shaft and sprocket to the position shown in FIGS. 8 and 9. The shaft 41 is formed with a diametrically extending slot 41*h* so as to be radially compressible in the region adjacent the protuberances 41*g*. With this arrangement, the shaft can be pressed axially inwardly from the position shown in FIGS. 8 and 9 to disengage a sprocket from the bead chain, for example by either pressing on the outer end of the worm gear or by manually turning the vane carrier in a counterclockwise direction as viewed in FIG. 9. Thus, the sprocket can be shifted axially inwardly relative to the chain retainer guides 31*c* and 31*d* to allow the bead chain to disengage from the sprocket so that the auxiliary carrier can be manually moved axially along the rod until the desired spacing relative to an adjacent auxiliary carrier is achieved. The sprocket is thereafter moved axially outwardly, as by applying torque on the vane support in a clockwise direction as viewed in FIG. 9, to re-engage the sprocket with the portions $OC_1$ and $OC_2$ of the bead chain.

In the adjustable rod using telescoping rod sections, the slide bodies must not only be adapted for sliding on the inner rod section or the outer rod section, but also where the two rod sections overlap as shown in FIG. 8. The guide walls 32*a*, 32*b* and 33*a*, 33*b* diverge outwardly from their bases at a shallow angle of the order of 5° and, in order to allow free movement of the slide bodies along the overlapping portions of the inner and outer rods, the spacing between the guide walls 32*a*, 32*b* and 33*a*, 33*b* is made substantially greater than the combined thickness of the upper and rear wall portions of the rod along opposite sides of the slot. In order to maintain the axis of the vane supports substantially vertical when the slides are in the overlapping portions of the rod sections $H_1$ and $H_2$, the upper inner guide wall 32*a* that engages the inside of the upper rear wall portion 24 is offset from the lower outer guide wall 33*b* that engages the outside of the lower rear wall portion 25 a distance slightly greater than twice the combined thickness of the overlapping rear wall portion of the rod. In order to maintain the vane support axis generally upright when the slides are supported on a single rod section such as an inner rod section $H_1$ or the outer rod section $H_2$, a lengthwise extending recess 33*c* (FIG. 8) is provided in the base of the lower groove in the slide body. The recess 33*c* has a width less than the combined thickness of overlapping lower rear wall portions of rod sections $H_1$ and $H_2$ to receive and ride on the upper edge of only a single rear wall portion. The lower recess is located laterally on the slide in relation to the upper guide edge 32*a* that engages the inner side of the upper rod wall portion to support the slide body on a single rod section $H_1$ or $H_2$ with the vane axis substantially vertical. Since the transverse width of the groove 33*c* is less than the combined thickness of the lower rear wall portions of the overlapping rod sections, the lower rear wall portions of the overlapping rod sections do not extend into the recess but instead ride on the base of the lower guide groove.

The master carrier LC comprises a slide body 55 having upper and lower grooves 55*a* and 55*b* for receiving the upper and lower rear wall portions 24 and 25 of the rod sections, to guide the lead carrier for movement along the rod. The lead carrier is moved along the rod by the traverse cord TC and the end caps $C_1$ and $C_2$ are constructed and arranged to provide cord guides for the traverse cord. The end caps $C_1$ and $C_2$ are of like construction, except that the end cap $C_1$ is dimensioned for reception in the end of the inner rod section $H_1$ and the end cap $C_2$ is dimensioned for reception in the end of the outer rod section $H_2$, and the like numerals are used to designate corresponding parts of the end caps $C_1$ and $C_2$. The end caps are conveniently molded in one piece of a synthetic resin material and each include an end wall 61 adapted to overlie the end of the respective rod section and rear wall portions 62*a* and 62*b* adapted to overlie the inside of the rear wall portions 24, 25 at the respective rod section. The rear wall portions 62*a* and 62*b* are spaced apart to define a notch 62*c* therebetween having a width corresponding to the width of the slot S in the rod sections and adapted to be aligned therewith to allow a carrier such as the lead carrier LC to slide from the rod section into the notch 62*c*, to positively locate the lead carrier in the end cap. In order to accurately locate the upper and lower rear wall portions 24 and 25 of the rod section relative to the rear wall portion 62*a* and 62*b* of the end cap, the rear wall portions 24 and 25 of the rod sections are formed with notches 24*a* and 25*a* respectively (FIG. 1) that open at one end of the rear wall portions and the wall portions 62*a* and 62*b* of the end caps are formed with generally T-shaped ribs 62*d* and 62*e* that are adapted to extend into the notches 24*a* and 25*a* to control the vertical spacing of the rear wall portion, and to overlie the rear sides of the rear wall portions of the rod adjacent the notches to laterally position the rear wall portions of the rod relative to the rear wall portions of the end cap. A latch 64 is formed on the end of a resilient arm integral with the end wall of the end cap and arranged to project into an opening 21*a* in the top wall of the respective rod section, to lock the end cap to the respective rod section.

Figure 2:
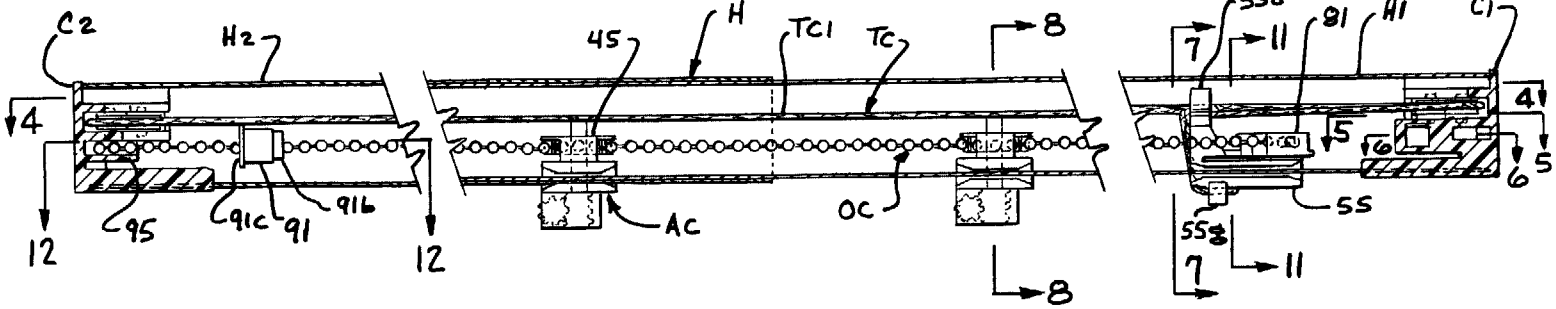
FIG. 2 is a horizontal sectional view through the vertical blind mechanism, with the traverse and operating cords arranged for right-hand operation (as viewed from the front of the rod)
Figures 4, 5, 6, 7:
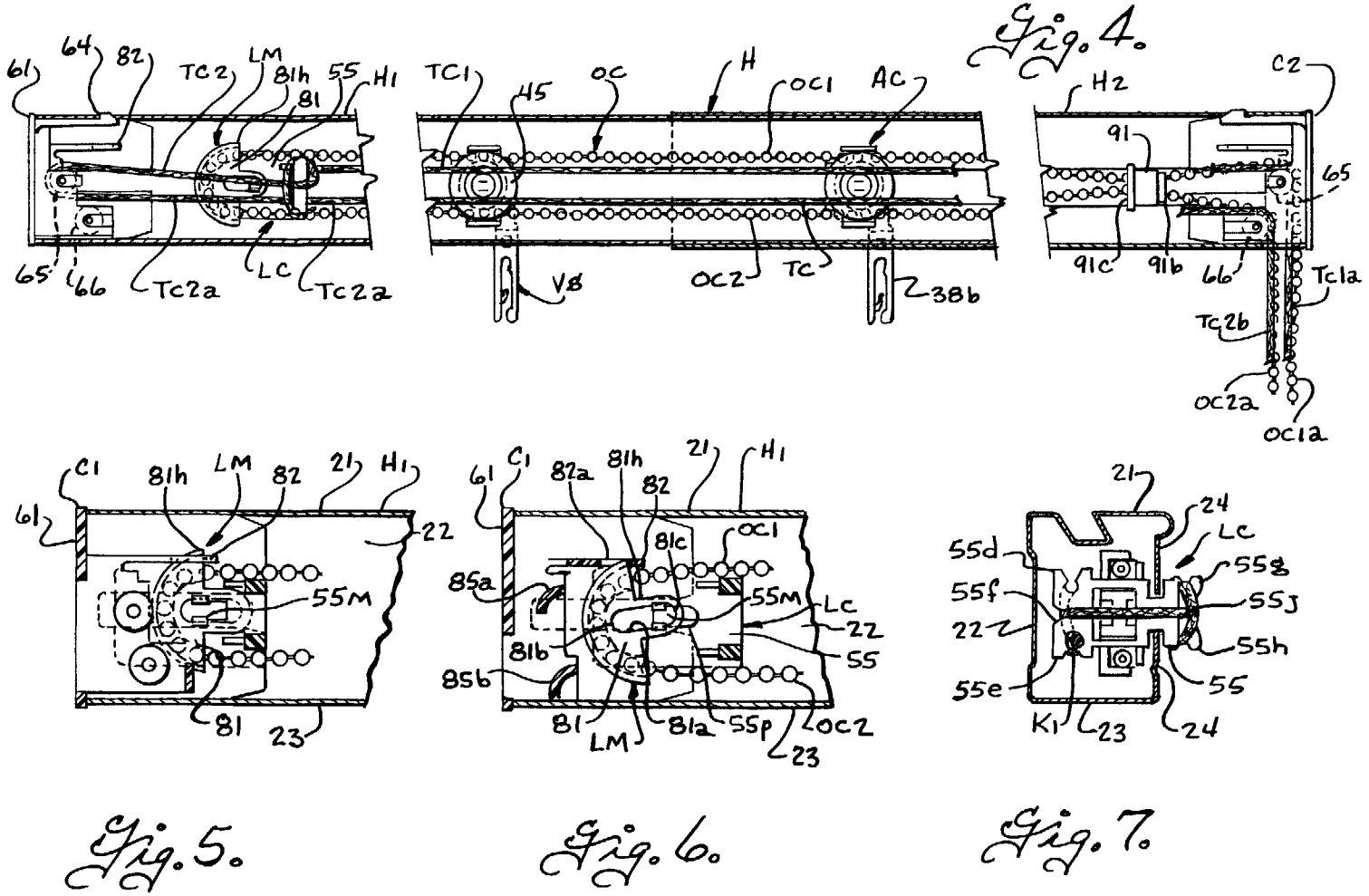
FIG. 4 is a longitudinal sectional view taken on the plane 4—4 of FIG. 2.
FIG. 5 is a fragmentary longitudinal sectional view taken on the plane 5—5 of FIG. 2 and showing parts of the lead carrier in a moved position and on a larger scale than FIG. 2.
FIG. 6 is a fragmentary longitudinal sectional view taken on the plane 6—6 of FIG. 2 and illustrating parts of the lead carrier in still another moved position and on a larger scale than FIG. 2.
FIG. 7 is a transverse sectional view taken on the plane 7—7 of the FIG. 2.

The traverse cord guides on the end caps $C_1$ and $C_2$ are best shown in FIGS. 2 and 4 and comprise a pair of rollers 65 and 66 supported for rotation about axes that are vertically and horizontally offset to enable the traverse to be arranged for either right-hand or left-hand draw. The traverse cord TC has one end portion $TC_1$ connected to the lead carrier LC and arranged to extend therefrom lengthwise of the rod and over the cord guide pulley 65 on the end cap on one end of the rod, and then downwardly to provide a first traverse cord operating portion $TC_{1a}$. The traverse cord also has a second portion $TC_2$ which is also connected to the lead carrier and which extends from the lead carrier lengthwise of the rod over a cord guide pulley 65 at the other end of the rod then in a return run $TC_{2a}$ lengthwise of the rod and over a cord guide pulley 66 at the first mentioned head of the rod and downwardly to provide a second traverse cord operating portion $TC_{2b}$. The operation portions $TC_{1a}$ and $TC_{2b}$ of the traverse cord are tensioned as by cord guides and, as will be seen, pulling on one of the traverse cord operating portions $TC_{1a}$ will move the lead carrier LC in one direction along the rod to an open position, and pulling on the other traverse cord operating portion $TC_{2b}$ will move the lead carrier in the opposite direction along the rod to a closed position.

Figure 3:
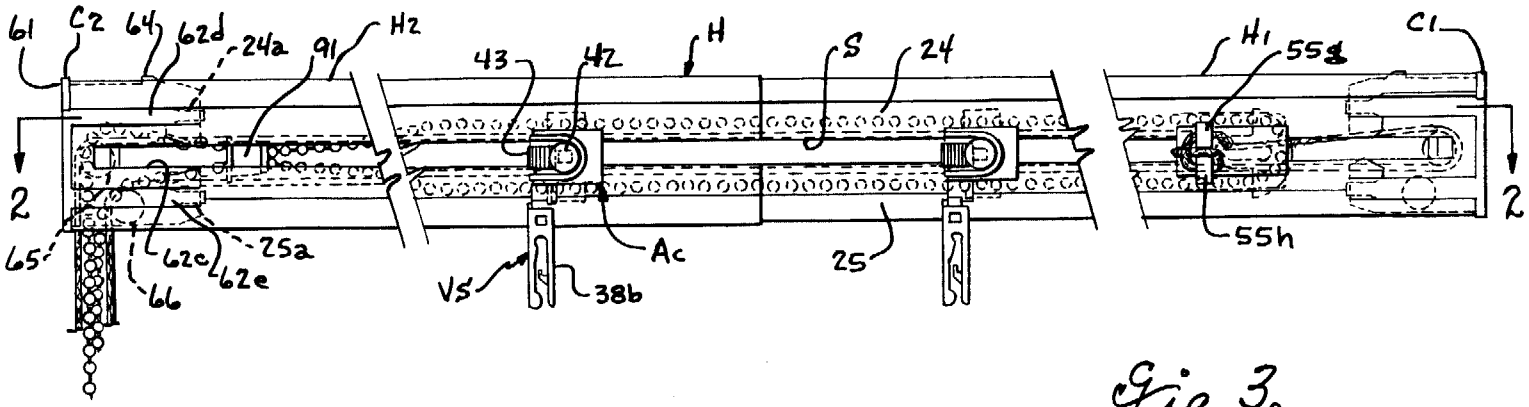
FIG. 3 is a rear elevational view of the vertical blind mechanism of FIG. 2.

An improved cord lock arrangement is provided for adjustably securing one end of the traverse cord to the lead carrier to facilitate adjustment of the length of the traverse cord with adjustments in the length of the header. As best shown in FIGS. 2, 3 and 7, the lead carrier has upper and lower inner cord retainers 55*d* and 55*e* on the slide body 55 inside the rod which define a notch 55*f* therebetween, and a second pair of upper and lower cord retainers 55*g* and 55*h* on the slide body outside the rod which define a notch 55*j* therebetween. The inner and outer upper cord retainers 55*d* and 55*g* have upwardly opening generally keyhole shaped notches, and the inner and outer lower cord retainers 55*e* and 55*h* have downwardly opening generally keyhole shaped notches. As will be seen from FIG. 7, the keyhole shaped notches have a generally circular base portion dimensioned to snugly receive the traverse cord and a V-shaped outer portion that intersects the circular base portion on a constricted area to allow the traverse cords to be pressed laterally into the notches and retained therein. The end of one of the traverse cord portions $TC_1$ is connected to the inner retainers and as best shown in FIG. 7, is snapped into the notch in the upper inner cord retainer 55*d* and then passed downwardly and snapped into the notch on the lower inner cord retainer 55*e*, with a knot $K_1$ provided at the end of the traverse cord portion $TC_1$. The end of the other traverse cord portion $TC_2$ is passed through the notch 55*f* between the upper and lower inner cord retainers and laterally outwardly across one end of the slide body 55 and through the notch 55*j* between the outer cord retainers, and is then looped around the upper and lower outer cord retainers 55*g* and 55*h* as shown in FIG. 3 and pressed into the notches therein. As will be seen from FIG. 3, the portion of the end of the traverse cord that passes between the upper and lower outer cord retainers crosses the portion of the traverse cord that passes through the notch 55*j*, to aid in retaining the traverse cord against detachment from the lead carrier. With this arrangement, the length of the traverse cord can be readily adjusted by merely pulling the end of the traverse cord $TC_2$ out of the outer cord retainers 55*g* and 55*h* and then pulling outwardly on the traverse cord until it is adjusted to the desired length, after which the end is again looped around the upper and lower outer cord retainers and pressed into the notches therein.

Figure 11:
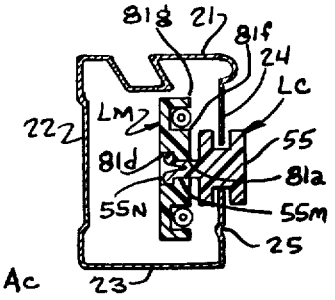
FIG. 11 is a transverse sectional view taken on the plane 11—11 of FIG. 2 and showing the parts on a larger scale than FIG. 2.

The lead carrier LC is also connected to the operating chain OC to draw the auxiliary carriers therewith when the lead carrier is extended to close the blind, and the latch mechanism LM is provided to releasably latch the lead carrier to one of the end caps. The latch mechanism LM comprises a latch member 81 mounted on the lead carrier and a keeper 82 on the end caps. The latch member 81 comprises a latch body that is slidably mounted on the inner side of the lead carrier body 55 for limited movement relative thereto in a direction paralleling the length of the rod. The latch body 81 has an elongated opening extending therethrough defining the laterally spaced side walls 81*a*, first and second end walls 81*b*, 81*c*, as best shown in FIG. 6 and inwardly opening recesses 81*d* (FIG. 11) in the opposite side walls 81*a*. The lead carrier 55 has resilient latch retaining lugs 55*m* extending laterally of the front side of the lead carrier body adapted to be received between the side walls 81*a* of the opening in the latch body, and flanges 55*n* on the outer ends of the lugs adapted to extend into the recesses 81*d* in the latch body as shown in FIG. 11. The lugs 55*m* have a length in a direction parallel to the length of the header which is short as compared to the length of the opening 81*a* so that the latch body can slide relative to the lead carrier body in a direction paralleling the length of the rod between a first position in which the first end 81*b* of the opening engages the lugs 55*m* as shown in FIG. 5 and a second position in which the second end 81*c* of the opening engages the lugs 81*m* as shown in FIG. 6. A guide rib 55*p* (FIG. 6) is also provided on the forward face of the lead carrier body and arranged to guidably engage the side walls 81*a* on the latch body, and the end 81*c* of the latch body is recessed to pass over the rib 55*e* during movement of the latch body from its first position to its second position. The rib 55*p* has a length which is long as compared with the transverse width of the slot and guides the latch body for sliding movement and effectively prevents tilting movement of the latch body relative to the slide body until the latch body reaches its second position. The lugs 55*m* are laterally resilient and, when the body reaches its second position, it can tilt a limited amount relative to the slide body in a direction crosswise of the header, the lugs 55*m* being laterally compressed during such tilting to resiliently urge the latch member back to a position in which the elongated slot is aligned with the rib 55*p*.

Figure 1:
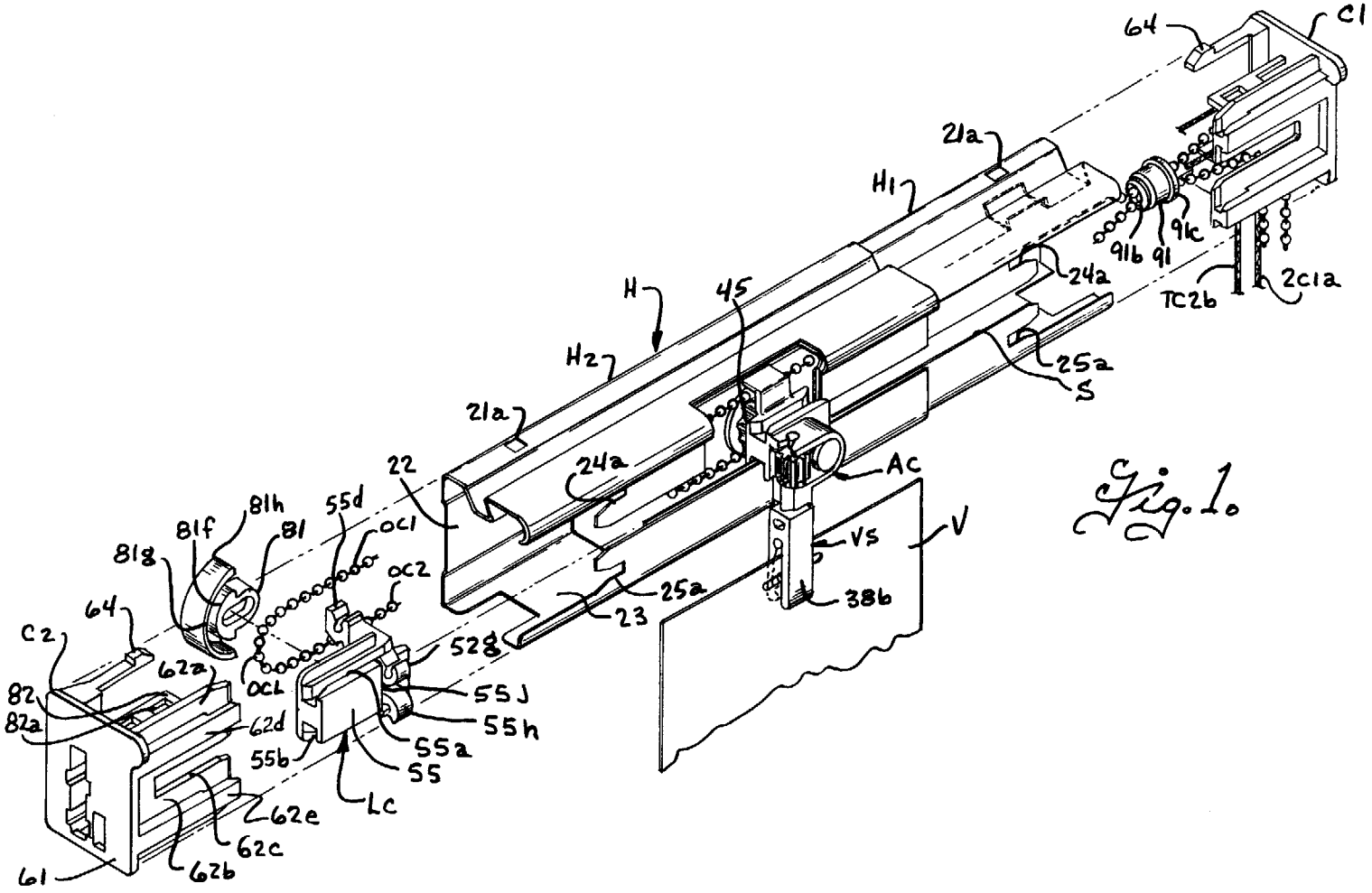
FIG. 1 is a fragmentary exploded perspective view of a vertical blind mechanism, arranged for left-hand operation (as viewed from the front of the rod)

The latch body is connected to the operating chains in a manner such that tension on the operating chain normally urges the latch body to its first position relative to the lead carrier. As best shown in FIGS. 1 and 11, the latch body has semi-circular inner and outer wall portions 81*f* and 81*g* that define an arcuate chain guide groove therebetween for receiving an end loop OCL of the operating chain OC. Latch noses 81*h* are formed on the ends of the outer wall portion 81*g* for engagement with the aforementioned keeper 82 on the end cap. The keeper 82 comprises a resilient blade like member having one end formed integrally with the end wall 61 of the end cap. The blade extends generally lengthwise of the rod and has an opening 82*a* adjacent at the free end adapted to receive a latch nose 81*h* on the latch body. The blade portion 82 is positioned in the path of travel of the nose portion 81*h* on the latch body and, when the lead carrier moves into the notch 62*c* on the end cap, the latch member is in its first position on the lead carrier and the arcuate lead face on the outer wall 81*g* of the latch member cams the keeper member upwardly until it passes over the nose portion 81*h*. The tension on the operating chain normally urges the latch body to its first position on the lead carrier and the keeper 82 normally operates to retain the lead carrier in its extended position. However, when the lead carrier is retracted by the traverse cords, the lead carrier moves relative to the latch member until the latch member reaches its second position. At that time, latch member can tilt relative to the lead carrier as shown in FIG. 6 and release engagement with the keeper.

Figure 12:
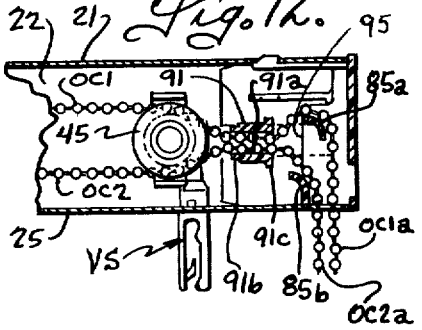
FIG. 12 is a fragmentary vertical sectional view taken on the plane 12—12 of FIG. 2 and illustrating parts in a moved position and on a larger scale than FIG. 2.

The operating chain has portions $OC_1$ and $OC_2$ that extend from the looped end OCL lengthwise of the header to the other end thereof, and provision is made for moving the chain portions $OC_1$ and $OC_2$ longitudinally relative to each other to effect rotation of the vane supports. As best shown in FIG. 12, the chain portions $OC_1$ and $OC_2$ extend over chain guides 85*a* and 85*b* on the end cap to downwardly extending operating portions $OC_{1a}$ and $OC_{2a}$ respectively. The chain guides 85*a* and 85*b* are vertically and horizontally offset from each other to vertically separate the chain portions $OC_1$ and $OC_2$ and to horizontally separate the chain portions $OC_{1a}$ and $OC_{2a}$. The operating portions $OC_{1a}$ and $OC_{2a}$ are conveniently connected in a loop by a bead chain connect to prevent pulling of one end of the operating chain out of the rod. As previously described, the auxiliary carriers are connected to the chain portions $OC_1$ and $OC_2$ at spaced locations therealong corresponding to the desired spacing between the centers of adjacent vane and, when the lead carrier LC is moved from an open position adjacent one end of the rod to a closed position adjacent the opposite end of the rod, it draws the looped end OCL of the bead chain therewith and pulls the auxiliary carriers along the rod while controlling the maximum spacing between adjacent auxiliary carriers. When the lead carrier is latched to the end cap in the closed position of the blind, pulling on one or the other operating portions $OC_{1a}$ or $OC_{2a}$ of the chain will move the chain portions $OC_1$ and $OC_2$ in relatively opposite directions and rotate the vane supports accordingly.

When the blind is in an open condition, the operating portions $OC_1$ and $OC_2$ of the bead chain form loops between adjacent carriers. If the operating portions of the bead chain $OC_{1a}$ or $OC_{2a}$ are pulled when the blind is in a partially or fully opened condition, the slack loops in the chain portions $OC_1$ and $OC_2$ sometimes become entangled or looped around other parts.

In accordance with the invention of Mark J. Terlecke, claimed in the copending application Ser. No. 061,380,033, filed May 20, 1982, and assigned to the assignee of the present application, a chain locking device 91 is provided for locking the chain portions $OC_1$ and $OC_2$ against longitudinal movement when the carriers are retracted to open the blind. The locking device 91 comprises a body having a chain guide passage means 91*a* therein for guidably engaging the first and second chain portions for movement in relatively opposite directions. In the embodiment illustrated, the locking device is in the form of a sleeve having a single guide passage for both the first and second chain portions, with the internal opening in the sleeve sufficiently greater than twice the cross-section of the bead chain to allow the chain portions $OC_1$ and $OC_2$ to pass in relatively opposite directions therethrough. The sleeve can have a circular cross-section as shown or an oblate cross-section, if desired. It is also contemplated, that separate guide passages could be provided in the device 91 for the chain portions $OC_1$ and $OC_2$. In order to facilitate guiding of the chain portions longitudinally therethrough, the guide passage means has a length somewhat greater than the pitch of the beads along the chain. The chain guide passage means is arranged to maintain the first and second chain portions passing therethrough spaced apart a distance substantially less than the pitch diameter of the sprockets on the auxiliary carriers to lock the first and second chain portions to the sprocket on an auxiliary carrier, when that carrier is retracted into engagement with the chain locking device. The chain locking device is preferably arranged to engage the chain portions $OC_1$ and $OC_2$ at a location adjacent one end cap such as to engage the sprocket on the adjacent end auxiliary carrier. However, it is contemplated that the chain locking device could also be arranged to engage the chain portions $OC_1$ and $OC_2$ at other locations intermediate adjacent ones of the auxiliary carriers. The locking device is conveniently arranged so that it is supported solely by the chain portions $OC_1$ and $OC_2$. However, it is also contemplated that the locking device could be supported on the end cap, provided it guides the chain portions $OC_1$ and $OC_2$ in the manner described above. When the locking device is located adjacent one end cap, a stop or shoulder 95 on the end cap engages one end of the locking device and limits movement of the locking device during retraction of the carriers. Thus, as the carriers are retracted, the sprocket on the adjacent end carrier in the rod moves to a position adjacent the other end of the locking device. If one or the other of the operation portions $OC_{1a}$ or $OC_{2a}$ of the chain is pulled while the carriers are retracted, the locking device 91 draws the chain portions $OC_1$ and $OC_2$ part way around the periphery of the sprocket on the adjacent auxiliary carrier to lock the chain portions to that sprocket and lock that sprocket against rotation. As will be seen from FIG. 12, the end 91*b* of the chain locking device adjacent the sprocket is preferably sufficiently thin to extend into the space between adjacent beads when the chain portions extend transverse to the end 91*b*, as occurs when a sprocket is closely adjacent the end 91*b*.

The chain locking device not only operates to lock the chain portions $OC_1$ and $OC_2$ when the auxiliary carriers are fully retracted, but it also provides a chain locking function when the lead carrier is not locked in its extended position. If the lead carrier is not locked in its extended position, a pull on one or other of the chain operating portions $OC_{1a}$ or $OC_{2a}$ will tend to retract the auxiliary carriers until the end auxiliary carrier engages the locking device. When the lead carrier is locked in its extended position on the rod, the chain portions $OC_1$ and $OC_2$ pull the end auxiliary carrier away from the locking device and the chain portions can then pass relatively free through the chain guide passages.

From the foregoing it is thought that the construction and operation of the vertical blind mechanism would be readily understood. The sprocket on one auxiliary carrier is assembled onto the drive shaft and onto the portions $OC_1$ and $OC_2$ of the operating chain at a location spaced from the loop portion OCL of the chain to provide the desired spacing of that auxiliary carrier and the vane supported thereby from one end of the rod, when the lead carrier is latched to the end cap on that end of the rod, and the sprockets are assembled on the other auxiliary carriers and on the portions $OC_1$ and $OC_2$ of the bead chain at spaced locations therealong corresponding to the desired spacing of adjacent vanes along the rod. The number of auxiliary carriers varies with the overall length of the rod and in the adjustable header construction shown, it is contemplated that auxiliary carriers can be removed from the bead chain if the header is shortened. In some installations, for example if the header is shortened a distance less than the spacing between the auxiliary carriers or a multiple thereof, then one or more of the auxiliary carriers can be adjusted along the bead chain while the carrier is assembled on the rod. This is achieved by shifting the drive shaft 41 on the auxiliary carrier axially to disengage the sprocket from the bead chain, followed by shifting of the carrier along the rod and re-engagement with the sprocket with the bead chain. The blind mechanism can be opened and closed by operating the traverse cords TC which moves the lead carrier along the rod between an open position adjacent one end of the rod to a closed position adjacent the other end of of the rod. The latch mechanism LM on the lead carrier engages a keeper on the end housing to releasably latch the lead carrier in a closed position. When the lead carrier is moved along the rod to a closed position, the looped end $OC_1$ of the operating chain is drawn with the lead carrier and this pulls the auxiliary carriers along the rod and controls the spacing between adjacent ones of the auxiliary carriers. When the lead carrier is in its closed position latched to the end cap on one end of the rod, the operating portions $OC_{1a}$ and $OC_{2a}$ of the operating chain can be drawn to move the chain portions $OC_1$ and $OC_2$ longitudinally in relatively opposite directions to drive the sprockets and rotate the vane supports. The slip clutch between the sprocket and the drive shaft in conjunction with the rotation stops on the vane supports, enables rotation of all of the vane supports on the rod to be synchronized by pulling the operating chain in one direction until all of the vane supports engage the rotation stop. The speed reducing drive between the sprocket and vane supports provides a very accurate angular adjustment of the vane supports and further reduces the force required to pull the operating chain. Opening of the blind is effected by pulling on the draw cord in a direction to move the lead carrier away from the end of the rod. The latch member remains in engagement with the keeper 82 until the lead carrier moves relative to the latch member to its second position relative to the lead carrier at which time the latch member can tilt relative to the lead carrier and disengage the keeper. Continued movement of the lead carrier along the rod causes the head carrier to push the auxiliary carriers together and toward the other end of the rod to an open position. When the blind is in an open condition, operation of the operating chain is effectively prevented by the locking device 91. Location of the slot at the rear side of the rod conceals the slot and the internal blind operating mechanism from view from the front or under side of the rod. Further, with the slot located at the rear of the rod, the bottom wall of the rod underlies and supports the operating chain and traverse cord, even when there are slack loops in the chain as occurs when the blind is open.

The embodiments of the invention in which an exclusive property or privilege is claimed are defined as follows:

1. A vertical blind mechanism comprising a horizontal rod having a lengthwise extending slot and track means along said slot, a plurality of auxiliary carriers mounted on the track means for movement along the rod and extending through the slot, a vane support mounted on each auxiliary carrier for turning about an upright axis, a sprocket mounted for axial rotation on each auxiliary carrier inside the rod, drive means connecting each sprocket to the associated vane support for turning the latter, a flexible operating chain having first and second chain portions inside the rod adapted to extend lengthwise of the rod, first and second chain guide means on each auxiliary carrier for respectively retaining the first and second chain portions in meshing engagement with the associated sprocket at diametrically opposite sides thereof, traverse means associated with one end of said first and second chain portions operable to move said one end of the first and second chain portions in a first direction along the rod to an extended position to draw the said first and second chain portions lengthwise along the rod, the first and second chain portions limiting maximum separation between adjacent auxiliary carriers when said one end of said first and second chain portions are extended along the rod, and means associated with the other ends of said first and second chain portions operable to move the first and second chain portions lengthwise in relatively opposite directions for rotating the sprockets to turn the vanes.

2. A vertical blind mechanism according to claim 1 wherein said drive means includes slip-clutch means between each sprocket and its associated vane support, and vane rotation stop means for limiting turning of each vane support.

3. A vertical blind mechanism according to claim 1 wherein said rod comprises inner and outer telescopically adjustable rod sections to enable adjustment of the overall length of the vertical blind mechanism.

4. A vertical blind mechanism according to claim 2 wherein said rod comprises telescopically adjustable inner and outer rod sections to enable adjustment of the overall length of the vertical blind mechanism.

5. A vertical blind mechanism according to claims 1, 2, 3, or 4 including means mounting the sprocket on at least one of the auxiliary carriers for limited axial movement relative to said first and second chain guide means between a first position in which the chain guides are operable to retain the first and second chain portions in meshing engagement with the associated sprocket and a second position in which at least one of the chain portions can disengage from the sprocket to enable adjustment of the spacing between said one auxiliary carrier and an adjacent auxiliary carrier, and means manipulable from outside the rod for moving said sprocket between said first and second positions.

6. A vertical blind mechanism according to claims 1, 2, 3, or 4 wherein the slot extends along the rear side of the rod, said drive means including a shaft mounted on each auxiliary carrier for rotation about a generally horizontal axis transverse to the rear side of rod, right angle gear means drivingly connecting the outer end of the shaft to the associated vane support, and means drivingly connecting the associated sprocket to the inner end of the shaft.

7. A vertical blind mechanism according to claims 1, 2, 3, or 4 wherein said drive means includes a speed-reducing gear means between each sprocket and its associated vane support.

8. A vertical blind mechanism according to claim 2 wherein said slip-clutch comprises a non-circular opening extending through each sprocket, said drive means including a shaft having a diametrically compressible portion extending into the opening in the sprocket and a protuberance on the periphery of the diametrically compressible portion engageable with the non-circular opening in the sprocket to provide slip-clutch drive.

9. A vertical blind mechanism according to claim 8 including means on the outer periphery of said diametrically compressible portion for engaging one side of the associated sprocket to limit axial movement of the sprocket relative to the shaft.

10. A vertical blind mechanism according to claim 3 wherein the slot extends along the rear side of the inner and outer rod sections and said track means comprises upper and lower rear rod wall portions above and below the slot in the respective rod sections, said auxiliary carriers including a slide body having an upper groove with inner and outer upper guide walls spaced apart to loosely receive the upper wall portions on the inner and outer rod sections where the rod sections overlap and a lower groove with inner and outer lower guide walls spaced apart to loosely receive the lower rod wall portions in the inner and outer rod sections where the rod sections overlap, said drive means including a shaft mounted on the slide body for rotation about a horizontal axis transverse to the rear side of the rod and intermediate said upper and lower grooves, right angle gear means drivingly connecting the outer end of the shaft to the associated vane support, means drivingly connecting the associated sprocket to the inner end of the shaft, the upper inner guide wall and the lower outer guide wall being offset from each other in a direction perpendicular to the shaft axis a distance to maintain the vane axis substantially vertical when the inner upper guide wall engages the inner side of the upper rear rod wall portion of the inner rod section and the outer lower guide wall engages the outer side of the lower rear rod wall portion of the outer rod section where the inner and outer rod sections overlap, the lower groove having a lengthwise recess in the base of the groove between the inner and outer lower guide walls, the width of the groove being less than the combined thickness of the lower rear rod wall portions on the inner and outer rod sections to guidably receive the lower rear rod wall portion on only a single one of the rod sections, the recess in the lower groove being located in relation to the upper inner guide wall to maintain the vane axis substantially vertical when the upper inner guide wall engages the inner side of the upper rear rod wall portion on a single rod section.

11. A vertical blind mechanism according to claim 1 wherein said traverse means includes a lead carrier mounted for movement along the rod, means on the lead carrier engaging said one end of first and second chain portions, and means for releasably retaining the lead carrier in a preselected extended position along the rod.

12. A vertical blind mechanism according to claim 1 wherein said traverse means includes a lead carrier mounted on the track means for movement along the rod, said means on said lead carrier engaging said one end of said first and second chain portions comprising a chain return guide mounted on the lead carrier, said operating chain being looped intermediate said first and second chain portions around said chain return guide.

13. A vertical blind mechanism according to claim 12 wherein said chain return guide is mounted on the lead carrier for limited movement relative thereto in a direction lengthwise of said rod between a first position on the lead carrier and a second position on the lead carrier spaced in said one direction from said first position, a latch keeper on the rod at a preselected location therealong, latch means on said chain return guide operative to engage said latch keeper to retain the lead carrier at said preselected location on the rod when the chain return guide is in said first position on the lead carrier and operative to disengage the latch keeper to release the lead carrier when the chain return guide is in said second position on the lead carrier.

14. A vertical blind mechanism according to claim 13 wherein chain return guide is supported for tilting relative to said lead carrier to release the latch means from the latch keeper when the chain return guide is in its second position on the lead carrier, and means restraining the chain return guide against tilting relative to the lead carrier when the chain return guide is in its first position on the lead carrier.

15. A vertical blind mechanism according to claim 14 wherein said latch keeper is resiliently yieldable in a direction laterally of the rod and said latch means includes a cam engageable with said latch keeper to cam the keeper laterally when the lead carrier is moved in said one direction.

16. A vertical blind mechanism according to claim 1 wherein said traverse means includes a lead carrier mounted on the trackway for movement along the rod and a chain return member mounted on the lead carrier, a keeper on the rod at a preselected location therealong, said chain return member having semi-circular inner and outer chain guide walls defining a U-shaped chain guide passage therebetween, said operating chain being looped intermediate said first and second portions in said U-shaped chain return passage, said chain return member having cam means engageable with the keeper to cam the keeper laterally when the lead carrier is moved in said one direction, means mounting the chain return member on the lead carrier for limited movement relative thereto between a first position on the lead carrier and a second position on the lead carrier spaced in said one direction from the first position, the chain return member being supported for tilting relative to the lead carrier in a direction crosswise of the header when in its second position on the lead carrier and being locked against tilting relative to the lead carrier when in its first position on the lead carrier.

17. A vertical blind mechanism according to claim 1 wherein said traverse means includes a lead carrier mounted for movement along the rod, a latch member mounted on the lead carrier for limited movement relative thereto in a direction lengthwise of a rod between a first position on the lead carrier and a second position on the lead carrier spaced in said one direction from said first position, means connecting the latch member to said one end of said first and second chain portions to draw the latch member to said first position when the first and second chain portions are under tension, a latch keeper on the rod at a preselected location therealong, said latch member being operative to engage said latch keeper to retain the lead carrier in said preselected position when the latch member is in said first position on the lead carrier and to disengage the latch keeper to release the lead carrier when the latch member is in said second position on the lead carrier.

18. A vertical blind mechanism according to claim 1 wherein said trackways comprise first and second rod wall portions along opposite sides of said slot, said first and second rod wall portions respectively having first and second notches opening at one end thereof, a rod end housing having first and second rib portions extending into said first and second notches to control the width of the slot at said one end of the first and second rod wall portions.

19. A vertical blind mechanism according to claim 1 wherein said trackways comprise first and second rod wall portions along opposite sides of said slot, said first and second rod wall portions respectively having first and second notches opening at one end thereof, a rod end housing having a housing wall parallel to and extending alongside the rod wall portions at said one end thereof, first and second ribs on said housing wall extending into said first and second notches to control the width of the slot and to retain said first and second rod wall portions in lateral abutting engagement with the housing wall, the housing wall having a slot extending into one end and aligned with the slot in the rod to receive a carrier.

20. A vertical blind mechanism according to claim 19 including a keeper on said end housing resiliently yieldable in a direction laterally of said header, said traverse means including a lead carrier, a latch member connected to said one end of said first and second chain portions, means mounting the latch member on the lead carrier for limited movement relative thereto in a direction lengthwise of the slot in the end housing between a first position on the lead carrier and a second position on the lead carrier spaced in said one direction from said first positions, the latch member being supported for tilting relative to the lead carrier in a direction crosswise of the rod when in its second position and on the lead carrier and being locked against tilting relative to the lead carrier when in its first position.

21. A vertical blind mechanism comprising, an elongated hollow rod having a slot extending lengthwise along the rear side and upper and lower rear wall portions defining trackways along opposite sides of the slot, a plurality of auxiliary carriers slidably mounted on the upper and lower rear wall portions of the rod and having an inner portion disposed inside the rod and an external portion disposed outside the rod, a vane support mounted on the external portion of each auxiliary carrier externally of the rod for turning about a generally upright axis, a drive shaft mounted on each auxiliary carrier for rotation about a generally horizontal axis transverse to the upper and lower rear wall portions of the rod and having an inner end inside the rod and an outer end outside of the rod, right angle gear drive means connecting the outer end of each drive shaft to the associated vane support, and flexible means disposed inside the rod and connected to the inner ends of the drive shafts on each of the auxiliary carriers for rotating the drive shafts about their horizontal axes to turn the vane supports about their upright axes.

22. A vertical blind mechanism according to claim 21 wherein the rod comprises telescoping inner and outer rod sections, said auxiliary carriers including a slide body leaving an upper groove with inner and outer upper guide walls spaced apart to loosely receive the upper wall portions on the inner and outer rod sections where the rod sections overlap and a lower groove with inner and outer lower guide walls spaced apart to loosely receive the lower rear rod wall positions in the inner and outer rod sections where the rod sections overlap, the upper inner guide wall and the lower outer guide wall being offset from each other in a direction perpendicular to the shaft axis a distance to maintain the vane axis substantially vertical when the inner upper guide wall engages the inner side of the upper rear rod wall portion of the inner rod section and the outer lower guide wall engages the outer side of the lower rear rod wall portion of the outer rod section where the inner and outer rod sections overlap, the lower groove having a lengthwise recess in the base of the groove between the inner and outer lower guide walls, the width of the groove being less than the combined thickness of the lower rear rod wall portions on the inner and outer rod sections to guidably receive the lower rear wall portion on only a single one of the rod sections, the recess in the lower groove being located in relation to the upper inner guide wall to maintain the vane axis substantially vertical when the upper inner guide wall engages the inner side of the upper rear rod wall portion on a single rod section.

23. A traverse rod mechanism comprising a rod having a lengthwise extending slot and first and second rod wall portions along opposite sides of said slot, a lead carrier and a plurality of auxiliary carriers mounted on the rod for movement along the slot, said first and second rod wall portions having first and second notches at one end thereof, a rod end housing having a housing wall parallel to and extending along the inner side of the rod wall portions at said one end thereof, and first and second ribs on said housing wall extending into the first and second notches to control the width of the slot at said one end of the rod and to retain the first and second rod wall portions in lateral abutting engagement with the housing wall.

24. A traverse rod and mechanism according to claim 23 excluding a slot extending into one end of said housing wall and aligned with the slot in the rod to receive a carrier.

25. A vertical blind mechanism comprising a horizontal rod having a lengthwise extending slot and track means along said slot, a plurality of auxiliary carriers mounted on the track means for movement along the rod and extending through the slot, a vane support mounted on each auxiliary carrier outside the rod for turning about an upright axis, vane drive means on each auxiliary carrier inside the rod and connected to the associated vane support for turning the latter, flexible means disposed inside the rod adapted to extend lengthwise of the rod, means connecting said vane drive means on the auxiliary carrier to the flexible means at spaced locations therealong, traverse means associated with one end of said flexible means operable to move said one end of the flexible means in a first direction along the rod to an extended position to draw the said flexible means lengthwise along the rod, the flexible means limiting maximum separation between adjacent auxiliary carriers when said one end of said flexible means is extended along the rod, and means associated with the other end of said flexible means for operating the drive means on the carriers to turn the vanes, said traverse means including a lead carrier mounted for movement along the rod and traverse cord means for moving the lead carrier along the rod, a latch member mounted on the lead carrier for limited movement relative thereto in a direction lengthwise of a rod between a first position on the lead carrier and a second position on the lead carrier spaced in said one direction from said first position, means connecting the latch member to said one end of said flexible means to draw the latch member to said first position when the flexible means is under tension, a latch keeper on the rod at a preselected location therealong said latch member being operative to engage said latch keeper to retain the lead carrier in said preselected position when the latch member is in said first position on the lead carrier and to disengage the latch keeper to release the lead carrier when the latch member is in said second position on the lead carrier.

* * * * *